US009857066B2

(12) United States Patent
Owens et al.

(10) Patent No.: US 9,857,066 B2
(45) Date of Patent: Jan. 2, 2018

(54) LED ILLUMINATION DEVICE WITH SINGLE PRESSURE CAVITY

(71) Applicant: Ephesus Lighting, Inc., Syracuse, NY (US)

(72) Inventors: Walten Peter Owens, Syracuse, NY (US); Christopher D. Nolan, Syracuse, NY (US); Joseph R. Casper, Syracuse, NY (US)

(73) Assignee: Ephesus Lighting, Inc., Syracuse, NY (US)

( * ) Notice: Subject to any disclaimer, the term of this patent is extended or adjusted under 35 U.S.C. 154(b) by 0 days.

(21) Appl. No.: 15/388,760

(22) Filed: Dec. 22, 2016

(65) Prior Publication Data

US 2017/0184288 A1 Jun. 29, 2017

Related U.S. Application Data

(60) Provisional application No. 62/271,488, filed on Dec. 28, 2015.

(51) Int. Cl.
*F21V 29/61* (2015.01)
*F21V 21/15* (2006.01)
(Continued)

(52) U.S. Cl.
CPC ..... *F21V 21/15* (2013.01); *F21S 2/005* (2013.01); *F21V 5/007* (2013.01); *F21V 15/01* (2013.01);
(Continued)

(58) Field of Classification Search
CPC ..... F21V 21/15; F21V 29/74; F21V 5/007; F21V 15/01; F21V 19/003;
(Continued)

(56) References Cited

U.S. PATENT DOCUMENTS 6,153,985 A 11/2000 Grossman
6,435,691 B1 8/2002 Macey et al.
(Continued)

FOREIGN PATENT DOCUMENTS

JP 2008166071 A 7/2008
JP 2013118064 A 6/2013
(Continued)

OTHER PUBLICATIONS

"A Remaining Useful Life Prediction Method Based on Condition Monitoring for LED Driver", Proceedings of the IEEE 2012 Prognostics and System Health Management Conference (PHM-2012 Beijing) (2012): 1-5. Web.
(Continued)

*Primary Examiner* — Anh Mai
*Assistant Examiner* — Nathaniel Lee
(74) *Attorney, Agent, or Firm* — Fox Rothschild LLP

(57) ABSTRACT

A light fixture includes a sealed path between a group of LED modules and a sensor cavity. The light fixture performs self-diagnosis and implements corrective measures upon detection of one or more environmental condition changes in the sealed path. In response to detecting an environmental condition change, the light fixture will automatically implement a corrective measure.

16 Claims, 7 Drawing Sheets

(51) Int. Cl.

| | |
|---|---|
| ***F21V 29/74*** | (2015.01) |
| ***F21S 2/00*** | (2016.01) |
| ***F21V 5/00*** | (2015.01) |
| ***F21V 19/00*** | (2006.01) |
| ***F21V 23/04*** | (2006.01) |
| ***F21V 15/01*** | (2006.01) |
| ***H05B 37/02*** | (2006.01) |
| ***G08B 21/18*** | (2006.01) |
| *F21V 31/03* | (2006.01) |

(52) U.S. Cl.
CPC ..... *F21V 19/003* (2013.01); *F21V 23/0442* (2013.01); *F21V 29/74* (2015.01); *G08B 21/182* (2013.01); *H05B 37/0272* (2013.01)

(58) Field of Classification Search
CPC .... F21V 23/0442; F21S 2/005; G08B 21/182; H05B 37/0272
See application file for complete search history.

(56) References Cited

U.S. PATENT DOCUMENTS

| | | | | |
|---|---|---|---|---|
| 6,962,423 | B2 | 11/2005 | Hamilton et al. | |
| 8,227,960 | B2 | 7/2012 | Huang | |
| 8,371,717 | B2 * | 2/2013 | Lai | F21V 23/0457 313/46 |
| 8,573,801 | B2 | 11/2013 | Artsyukhovich et al. | |
| 8,760,058 | B2 | 6/2014 | Song et al. | |
| 8,841,859 | B2 | 9/2014 | Chemel et al. | |
| 2005/0263777 | A1 | 12/2005 | Yano et al. | |
| 2005/0265019 | A1 | 12/2005 | Sommers et al. | |
| 2007/0262724 | A1 | 11/2007 | Mednik et al. | |
| 2008/0025028 | A1 | 1/2008 | Gloisten et al. | |
| 2009/0040470 | A1 | 2/2009 | Fukui et al. | |
| 2009/0067172 | A1 | 3/2009 | Inoue et al. | |
| 2009/0289580 | A1 * | 11/2009 | Dunn | H05B 33/0872 315/307 |
| 2010/0096993 | A1 * | 4/2010 | Ashdown | F21V 29/004 315/113 |
| 2010/0117553 | A1 | 5/2010 | Lee | |
| 2010/0171145 | A1 | 7/2010 | Morgan et al. | |
| 2010/0225241 | A1 | 9/2010 | Maehara et al. | |
| 2010/0277076 | A1 | 11/2010 | Tracy et al. | |
| 2011/0050124 | A1 | 3/2011 | Bailey et al. | |
| 2011/0062872 | A1 | 3/2011 | Jin et al. | |
| 2011/0073159 | A1 | 3/2011 | Shen et al. | |
| 2011/0075433 | A1 | 3/2011 | Mart et al. | |
| 2011/0089865 | A1 | 4/2011 | Wang et al. | |
| 2011/0095690 | A1 | 4/2011 | Sagal | |
| 2011/0228529 | A1 | 9/2011 | Patel et al. | |
| 2011/0266972 | A1 | 11/2011 | Ling | |
| 2012/0033419 | A1 | 2/2012 | Kim et al. | |
| 2012/0153837 | A1 | 6/2012 | Park et al. | |
| 2012/0235579 | A1 | 9/2012 | Chemel et al. | |
| 2012/0261105 | A1 | 10/2012 | Lin et al. | |
| 2013/0033881 | A1 | 2/2013 | Terazawa et al. | |
| 2013/0077307 | A1 | 3/2013 | Yamamoto | |
| 2013/0249375 | A1 | 9/2013 | Panagotacos et al. | |
| 2014/0159583 | A1 | 6/2014 | Bollmann | |
| 2014/0204584 | A1 | 7/2014 | Wu | |
| 2015/0054410 | A1 | 2/2015 | Sanders et al. | |
| 2015/0243143 | A1 | 8/2015 | Chen | |

FOREIGN PATENT DOCUMENTS

| | | | |
|---|---|---|---|
| KR | 20030031339 | A | 4/2003 |
| KR | 20140051665 | A | 5/2014 |
| WO | WO-2013090536 | A1 | 6/2013 |

OTHER PUBLICATIONS

International Search Report dated Apr. 29, 2013 for PCT/US2012/069442, international filing date Dec. 13, 2012.

* cited by examiner

LED ILLUMINATION DEVICE WITH SINGLE PRESSURE CAVITY

RELATED APPLICATIONS AND CLAIM OF PRIORITY

This patent document claims priority to U.S. provisional patent application No. 62/271,488, filed Dec. 28, 2015, the disclosure of which is hereby incorporated by reference in full.

BACKGROUND

The advent of light emitting diode (LED) based luminaires has provided sports arenas, stadiums, other entertainment facilities, and other commercial and industrial facilities the ability to achieve instant on-off capabilities, intelligent controls and adjustability while delivering excellent light quality, consistent light output, and improved energy efficiency. Because of this, users continue to seek improvements in LED lighting devices. For example, new and improved ways to direct light in multiple directions, and to provide luminaires with high light output in a compact package, are desired.

This document describes new illumination devices that are directed to solving the issues described above, and/or other problems.

SUMMARY

In an embodiment, a light fixture includes a body portion with a housing. The housing has an opening at a first end, and a set of light emitting diode (LED) modules. Each LED module includes a circuit board and one or more LEDs, and is positioned within the opening. The housing also includes a sensor cavity in which one or more sensors are positioned, and conduits that provide a sealed path between the LED modules and the sensor cavity. In this way, the circuit boards and LEDs of the LED modules, the conduits and the sensor cavity are configured so that various environmental conditions are maintained at a constant levels within the sealed path. The sensors are configured to monitor the environmental conditions in the sealed path.

Optionally, the housing also includes a circuit board cavity that includes a circuit board with control electronics. If so, the conduits also provide a sealed path between the LED modules, the sensor cavity, and the circuit board cavity. The housing also may include a power supply cavity that contains a power supply, and if so the conduits may also provide a sealed path between the LED modules, the sensor cavity, and the power supply cavity.

Optionally, each LED module includes: one or more lenses, each of which is positioned over a corresponding LED or group of LEDs; a circuit board on which the one or more LEDs are mounted; and a frame that holds the one or more LEDs, lenses and circuit board.

The sensors may include one or more of the following: a pressure sensor, a temperature sensor, a humidity sensor, a chemical substance sensor, a fire sensor, a particulate sensor, a biological agent sensor, a moisture sensor, an air speed detector, or an orientation sensor. The environmental conditions may include one or more of the following: pressure, temperature, humidity, chemical substance presence, or particulate matter presence.

The light fixture also may include a processor in communication with the one or more sensors and a computer-readable medium containing programming instructions. The programming instructions may be configured to cause the processor to receive data corresponding to the environmental conditions from the one or more sensors, and analyze the data to determine if at least one of the environmental conditions has undergone one or more of the following: (i) a change so that a value of the at least one environmental condition exceeds a threshold level; (ii) a threshold change compared to corresponding constant level; (iii) or a rate of change that is greater than a threshold value. In response to detecting a change that exceeds the threshold level, the threshold change or the rate of change that is greater than the threshold value, the processor may cause the light fixture to execute a corrective measure and/or generate an alert. Examples of corrective measures include, but are not limited to, shutting off power to one of the LED modules of the light fixture, shutting off power to all of the LED modules of the light fixture, or causing a motor to adjust an orientation of the light fixture.

In an embodiment, the light fixture includes a processor in communication with the one or more sensors, and a computer-readable medium containing programming instructions that are configured to cause the processor to turn off one or more of the LED modules upon receipt of data from the one or more sensors indicating that an air pressure level or humidity level within the sealed path has risen above an upper threshold level.

In an embodiment, the light fixture includes: a vent; a processor in communication with the one or more sensors; and a computer-readable medium containing programming instructions that are configured to cause the processor to open the vent upon receipt of data from the one or more sensors indicating that the air pressure level or humidity level within the sealed path has risen above an upper threshold level.

In an embodiment, the light fixture includes: a pump; a processor in communication with the one or more sensors; and a computer-readable medium containing programming instructions that are configured to, when executed by the processor, cause the fixture to initiate operation of the pump upon receipt of data from the one or more sensors indicating that the air pressure level or humidity level within the sealed path has fallen below a lower threshold level.

In an embodiment, the light fixture includes: a processor in communication with the one or more sensors; a computer-readable medium containing programming instructions that are configured to cause the processor to receive data from the one or more sensors and cause the light fixture to perform a self-diagnostic function; and a transmitter configured to transmit the data from the one or more sensors, an output of the self-diagnostic function, or both to a remote receiver.

In some embodiments, the sensor cavity is positioned proximate a rear end of the body portion that is opposite the opening, and the conduits pass from the opening to the sensor cavity through the body portion. In some embodiments, the body portion comprises a heat sink between the opening and the sensor cavity.

In an embodiment, a method for performing self-diagnosis in a light fixture includes receiving data corresponding to environmental conditions from one or more sensors. The sensors are positioned in a sensor cavity of a light fixture, and a set of conduits provide a sealed path between a group of LED modules of the light fixture and the sensor cavity such that the LED modules. A processor will analyze the data to determine if at least one of the environmental conditions in the sealed path has undergone one or more of the following changes: a change so that a value of the at least one environmental condition exceeds a threshold level; a threshold change compared to a corresponding constant level; or a rate of change that is greater than a threshold value. In response to detecting that at least one of the environmental conditions has undergone at least one of the changes, the method will include automatically implementing a corrective measure in the light fixture.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to."

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a light fixture is oriented in a first direction. The relative orientations of the components may be reversed, or the components may be on the same plane, if the orientation of a light fixture that contains the components is changed. The claims are intended to include all orientations of a device containing such components.

"Electronic communication" refers to the ability to transmit data via one or more signals between two or more electronic devices, whether through a wired or wireless network, and whether directly or indirectly via one or more intermediary devices.

When this document uses the term "processor" or "processing device," unless expressly stated otherwise it is intended to include embodiments that consist of a single data processing device, as well as embodiments that include two or more data processing devices that together perform various steps of a described process.

When this document uses the terms "memory," "memory device," "computer-readable memory," "computer-readable medium," or "data storage facility," unless expressly stated otherwise it is intended to include embodiments that consist of a single memory device, embodiments that include two or more memory devices that together store a set of data or instructions, or one or more sectors or other portions of a memory device.

Figure 1:
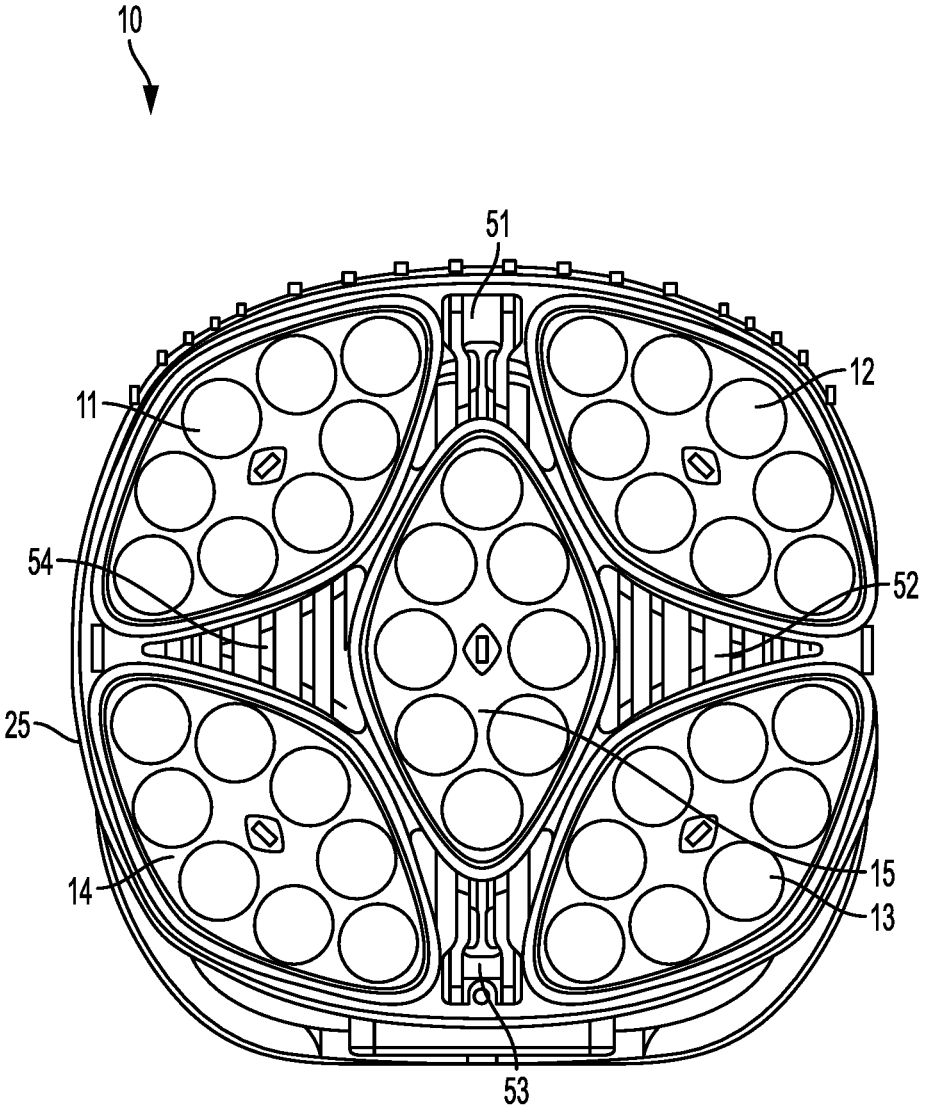
FIG. 1 illustrates a front view of an example of one embodiment of the illumination devices disclosed in this document.
Figure 2:
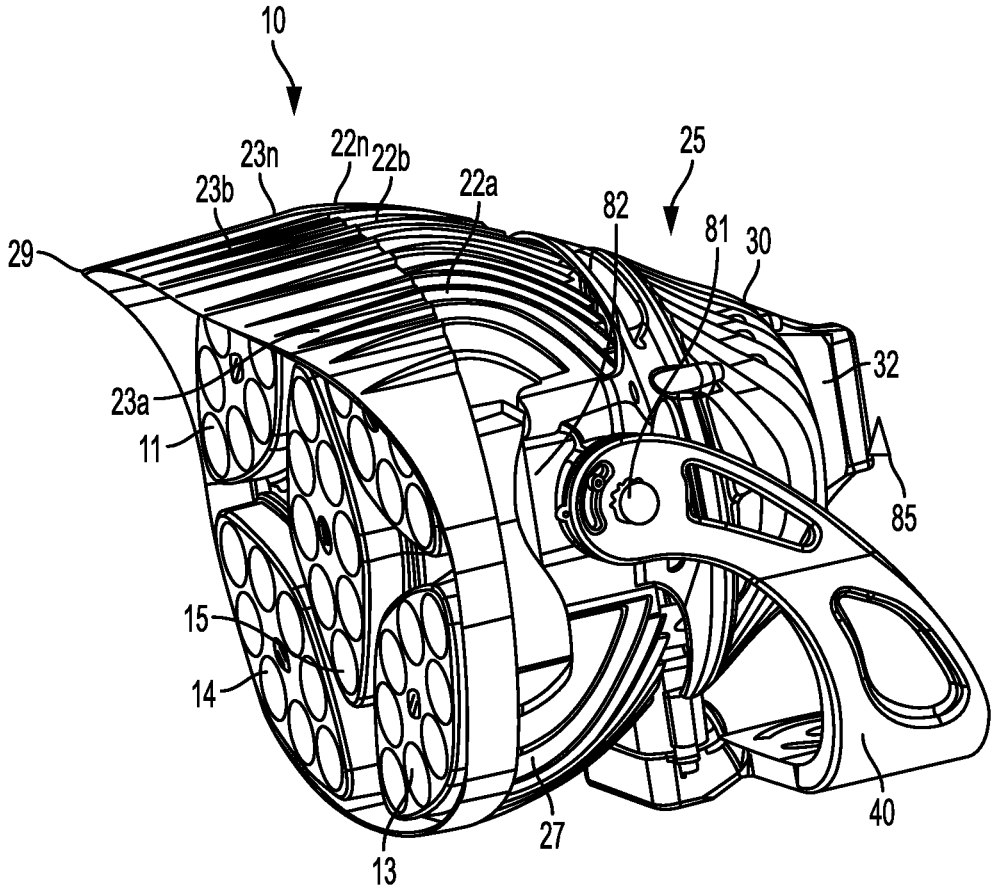
FIG. 2 provides a perspective view of the device of FIG. 1.

FIG. 1 illustrates a front view of an example of one embodiment of the illumination devices disclosed in this document. FIG. 2 illustrates a view from one side of the device of FIG. 1, while FIG. 2 provides a perspective view. The illumination device 10 includes a housing 25 that encases various components of a light fixture. As shown in FIG. 1, the housing 25 includes an opening in which a set of light emitting diode (LED) modules 11-15 are secured to form a multi-module LED structure. The LED modules 11-15 are positioned to emit light away from the fixture. Each LED module includes a frame that holds a set of LEDs arranged in an array or other configuration. In various embodiments the number of LEDs in each module may be any number that is sufficient to provide a high intensity LED device. Each LED module will also include a substrate on which the LEDs, various conductors and/or electronic devices, and lenses for the LEDs are mounted.

The opening of the housing 25 may be circular, square, or a square with round corners as shown in FIG. 1, although other shapes are possible. The LED modules 11-15 may include five modules as shown, with four of the modules 11-14 positioned in a quadrant of the opening and the fifth module 15 positioned in the center as shown. Alternatively, any other number of LED modules, such as one, two, three, four or more LED modules, may be positioned within the opening in any configuration.

The device's housing 25 includes a body portion 27 and an optional shroud portion 29. The body portion 27 serves as a heat sink that dissipates heat that is generated by the LED modules. The body/heat sink 27 may be formed of aluminum and/or other metal, plastic or other material, and it may include any number of fins 22*a* . . . 22*n* on the exterior to increase its surface area that will contact a surrounding cooling medium (typically, air). Thus, the body portion 27 or the entire housing 25 may have a bowl shape as shown, the LED modules 11-15 may fit within the opening of the bowl, and heat from the LED modules 11-15 may be drawn away from the LED modules and dissipated via the fins 22*a* . . . 22*n* on the exterior of the bowl.

While the LED modules are positioned at the front of body portion 27, the opposing side of the body portion may be attached to a power supply unit 30, optionally via a thermal interface plate. The power supply unit 30 may include a battery, solar panel, or circuitry to receive power from an external and/or other internal source. A power supply unit 30 may be positioned at the rear of the body (i.e., at the bottom of the bowl), and the interior of the unit may include wiring or other conductive elements to transfer power and/or control signals from the power supply unit 30 to the LED modules 11-15. The power supply 30 may be positioned at or near the rear of the body as shown, or it may be placed into the housing so that it is flush or substantially flush with the rear of the body 27, or it may be configured to extend to some point between being flush with the body portion 27 and an extended position. A sensor cavity 32 may be attached to the power supply and/or other part of the device as shown, and it may contain sensors and/or control and communications hardware for sensing parameters of and controlling the device, receiving commands, and transmitting data to remote control devices.

The housing 25 may be formed as a single piece, or it may be formed of two pieces that fit together as in a clamshell-type structure. In a clamshell design, a portion of the interior wall of the clamshell near its opening may include a groove, ridge, or other supporting structure that is configured to receive and secure the LED structure in the opening when the clamshell is closed. In addition, the fins 22*a* . . . 22*n* may be curved or arced as shown, with the base of each fin's curve/arc positioned proximate the opening/LED modules, and the apex of each fin's curve/arc positioned distal from the opening/LED modules to further help draw heat away from the LED modules. The housing may be attached to a support structure 40, such as a base or mounting yoke, optionally by one or more connectors 81. As shown, the connectors 81 may include axles about which the housing and/or support structure may be rotated to enable the light assembly to be positioned to direct light at a desired angle. The light fixture may include or be connected to a motor 82 that, when actuated, causes the housing to rotate about the connectors and adjust an orientation of the lighting device. Other motors may be used in different locations (such as attached to the mounting yoke) to adjust pitch, yaw, or other positional aspects of the lighting device.

The power supply unit 30 may be detachable from remainder of the lighting device's housing 25 so that it can be replaced and/or removed for maintenance without the need to remove the entire device from an installed location, or so that it can be remotely mounted to reduce weight. The power supply unit 30 and/or a portion of the lighting unit housing 25 may include one or more antennae, transceivers or other communication devices 85 that can receive control signals from an external source. For example, the illumination device may include a wireless receiver and an antenna that is configured to receive control signals via a wireless communication protocol. Optionally, a portion of the lighting unit housing 25 or shroud 29 (described below) may be equipped with an attached laser pointer that can be used to identify a distal point in an environment to which the lighting device directs its light. The laser pointer can thus help with installation and alignment of the device to a desired focal point.

FIGS. 1 and 2 show that the device may include a shroud 29 that protects and shields the LED modules 11-15 from falling rain and debris, and that may help direct light toward an intended illumination surface. The shroud 29 may have any suitable width so that an upper portion positioned at the top of the housing is wider than a lower portion positioned at the bottom and/or along the sides of the opening of the housing. This may help to reduce the amount of light wasted to the atmosphere by reflecting and redirecting stray light downward to the intended illumination surface. FIG. 2 illustrates that in an embodiment, some or all of the fins 22*a* -22*n* of the housing may be contiguous with fin portions 23*a*-23*n* that extend across the shroud 29. With this option, the shroud 29 can also serve as part of the heat sink.

The fins 22*a* . . . 22*n* may be positioned substantially vertically (i.e., lengthwise from a top portion of the LED array structure and shroud 29 to a bottom portion of the same). Optionally, one or more lateral supports may be interconnected with the fins to provide support to the housing. The lateral supports may be positioned substantially parallel to the axis of the fins, or they may be curved to extend away from the LED structure, or they may be formed of any suitable shape and placed in any position. Each support may connect two or more of the fins. The fins and optional supports form the body portion 27 as a grate, and hot air may rise through the spaces that exist between the fins and supports of the grate. In addition, precipitation may freely fall through the openings of the grate. In addition, any small debris (such dust or bird droppings) that is caught in the grate may be washed away when precipitation next occurs.

Figure 3:
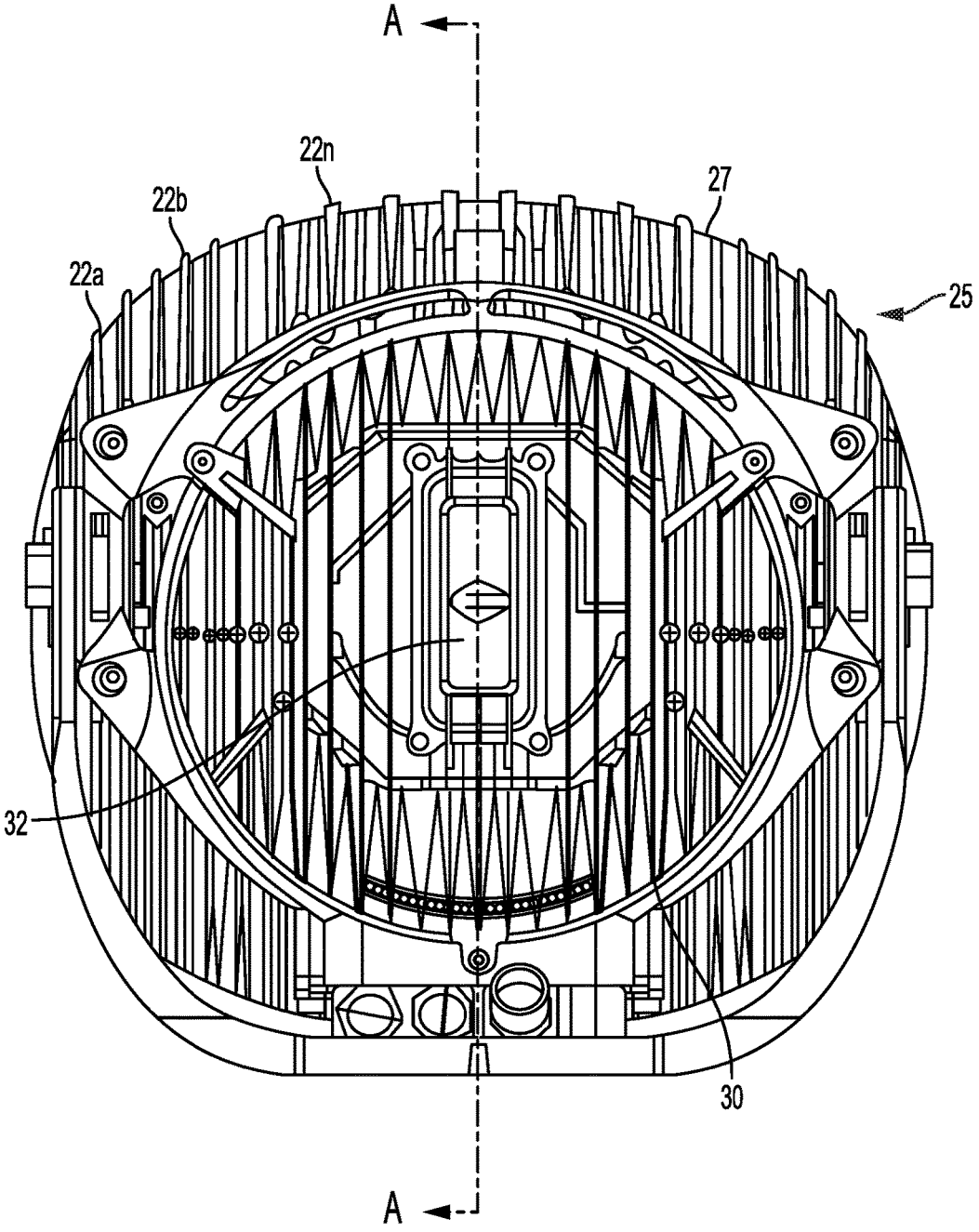
FIG. 3 illustrates an embodiment of the lighting device, viewed from the rear.

FIG. 3 illustrates an embodiment of the lighting device as viewed from the rear. As with the other views, the fins 22*a* . . . 22*n* may be positioned substantially vertically to form a heat sink. The power supply 30 and sensor cavity 32 may be connected at the rear of the device as shown.

Figure 4:
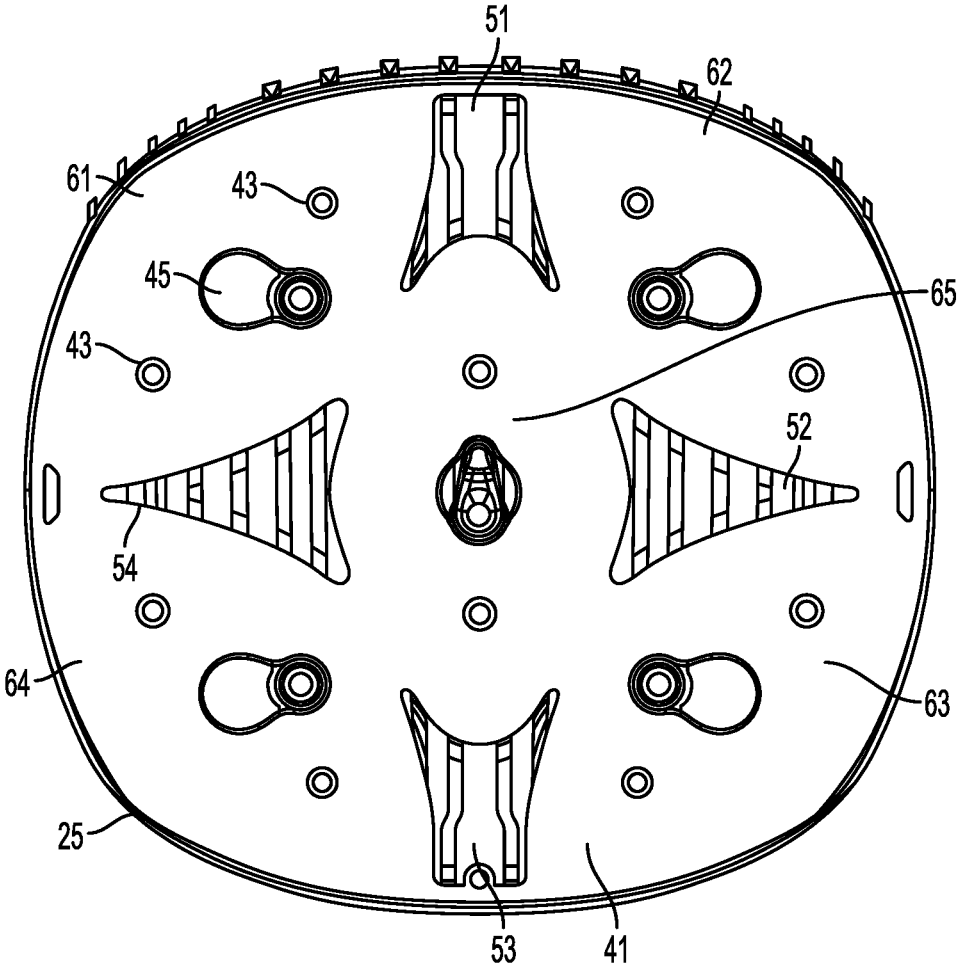
FIG. 4 illustrates a view of the heatsink, as viewed from the opening (front) of the device with the LED modules removed.

FIG. 4 shows the front of the device with the LED modules removed, to expose a mating surface 41 to which the LED modules are mounted. The mating surface 41 is connected to the fins and has a front surface with a lateral dimension that is parallel to the fins, so that the mating surface substantially fills the opening in front of the lighting device, and the fins extend away from the mating surface toward the rear of the device. In an embodiment, the mating surface and fins may be formed by being cast or molded from a common material, such aluminum, an alloy, or a ceramic material. The mating surface 41 includes a number of landing pads 61-65 that corresponds to the number of LED modules. Each landing pad comprises an area of the surface with one or more connectors 43 (such as openings to receive a bolt) that are configured to secure an LED module to the mating surface 41. Each landing pad also may include one or more openings 51-54 that serve as openings to conduits (described below in the discussion of FIGS. 5 and 6) that provide a sealed path between the LED modules and other components of the lighting device.

Figure 5:
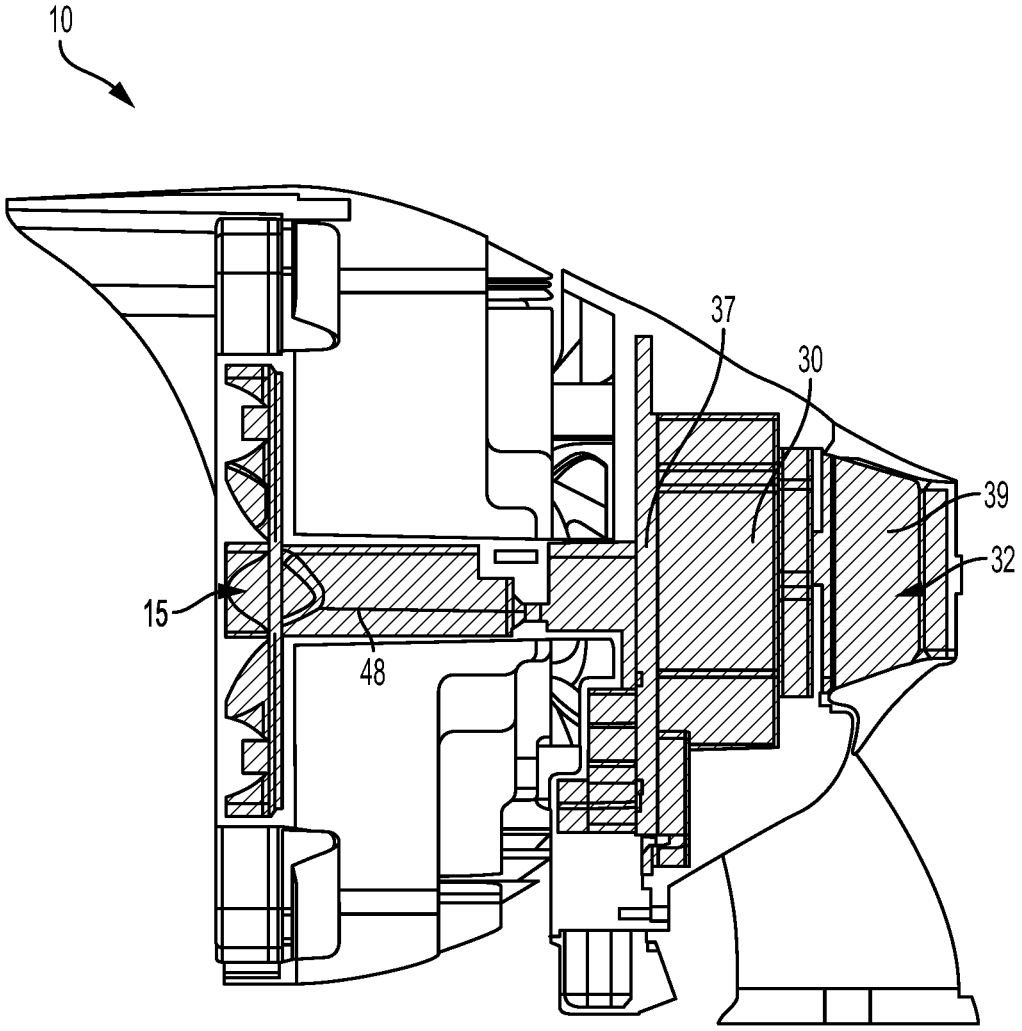
FIGS. 5 and 6 illustrate cutaway views of the lighting device of FIG. 1, showing a pathway between the LED modules and the power supply contained within the heat sink.
Figure 6:
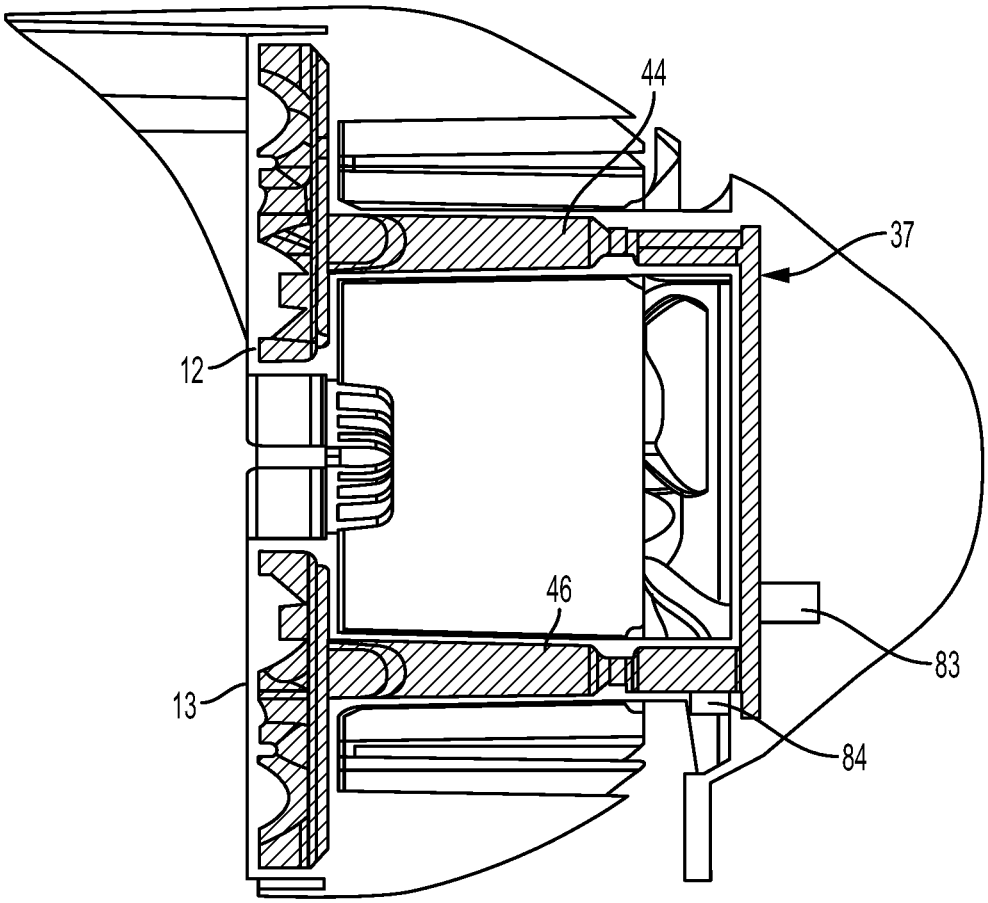

FIG. 5 illustrates a cut-away view of the device 10, in which the power supply unit 30 is connected to an electronic control board 37 and one or more sensors 39 that are contained in the sensor cavity 32. Some or all of the LED modules 15 are connected to the housing and also to one or more conduits 48 that provide a sealed path via which wires or other conductors extend between the sensor cavity 32, power supply 30 and/or control board 37 and the LED modules 15 for delivery of power and/or control signals. In an alternate embodiment, one or more sensors may also be included in the conduit. Each LED module may include a corresponding conduit so that each LED may receive its power and control signals from the control board 37, and so that the environment within the conduit may be monitored by the sensors 39 in the sensor cavity 32 and/or the conduit. FIG. 6 illustrates a different cutaway section showing how conduits 44, 46 may lead from LED modules 12, 13 to a channel that contains the control board 37. Examples of the one or more sensors may include, without limitation, a pressure sensor (such as barometer), a temperature sensor, a humidity sensor, a chemical substance sensor, a fire sensor, a particulate sensor, a biological agent sensor, a moisture sensor, an air speed detector, a micro-electro-mechanical system type sensor (such as an accelerometer, gyroscope or other orientation sensor, a pressure sensor), or the like.

The conduits 44, 46, 48 may be made of aluminum, plastic, or another lightweight, weather-resistant material. The conduits 44, 46, 48 are sealed to the LED modules at one end and to the sensor cavity 32 at the other end, and thus provide a sealed path that is sealed to external elements and is airtight and water-resistant. In this way, the desired optimal conditions may be maintained in the conduit (sealed path), such as a constant air pressure, constant temperature, or the like. For example, in an embodiment, the sealed path may be maintained at a pressure of about 0.9 atm to about 1.1 atm. Furthermore, the sensors may be able to monitor the conditions within the sealed path without external influence, which may be used as an indication of the conditions associated with the LED modules and/or the LEDs. For example, the sensors may include a humidity, temperature, and/or pressure sensor positioned to monitor the air pressure, temperature, and/or the humidity within the sealed path. A chemical sensor may be included to detect the presence of one or more particular substances in the sealed path.

In an embodiment, the sensors may be connected directly to or proximate the rear of the LED modules. Alternatively and/or additionally, the sensors may be positioned so that one or more other components, such as the power supply and control board, are also in the sealed path. Because the path is sealed from the external environment, a single pressure sensor, a single temperature sensor, a single humidity sensor, and/or a single chemical sensor may be sufficient to monitor the pressure, temperature, humidity, or chemical substance within the electronics component housing, LED modules, and the intervening conduits.

The components of an illumination device may malfunction if the conditions surrounding the LED modules and/or other components vary from the desired optimal conditions (based on threshold values) and/or change suddenly. For example, humidity or moisture levels above a threshold level may cause short-circuiting, presence of particulates like dust above a threshold level may affect the quality of light, or other similar malfunctions. Alternatively and/or additionally, such changes in the conditions surrounding the LED modules and/or other components may be an indication of currently existing faults in the illumination device. Examples may include, without limitation, a change in temperature may be indicative of a fault with the heat sink of the illumination device which if unchecked may lead to breakdown of the illumination device; a change in pressure may be indicative of cracks or faults in the lens cover of an illumination device; presence of a chemical substance may be indicative of outgassing (such as from windings of an inductive magnetic coil) or of component degradation that can be adversely deposited upon a viewing surface; or the like. Hence, it is important to monitor the conditions surrounding the LED modules and/or other components of an illumination device, detect changes and/or rates of change, perform error corrective steps, and/or generate an alert in response to the detection. Hence, in an embodiment, the lighting device may include software and/or firmware that uses data detected by the sensors to perform a self-diagnostic function to detect changes and/or rates of change, perform corrective steps (such as activating a pump 83 to increase pressure or opening a vent 84 to relieve pressure in the sealed path), and/or generate an alert in response to the detection.

In an embodiment, the illumination device may include a control card and/or a processor that is in electronic communication with the sensor cavity so that it can receive data receive data generated from one or more sensors and process the above data to perform the self-diagnostic function. Alternatively and/or additionally, the processor may transmit the detected data to a remote device and receive instructions to perform some or all of the self-diagnostic functions.

The illumination device may also include a computer-readable medium containing programming instructions that, when executed, cause the illumination device's processor to analyze data received from the sensor cavity to detect changes and/or rates of change, perform error corrective steps and/or generate an alert in response to the detection.

Figure 7:
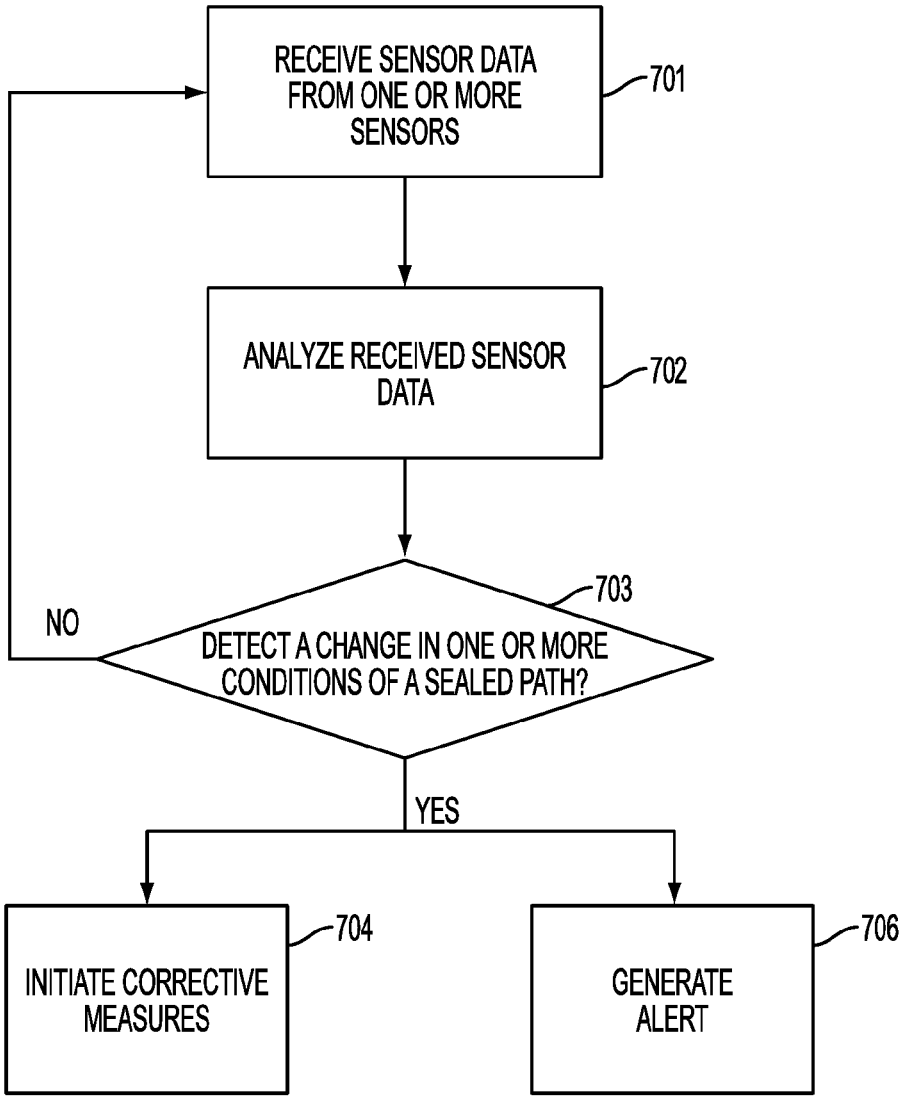
FIG. 7 illustrates a flowchart for an example method of performing self-diagnostics in an illumination device of FIG. 1, according to an embodiment.

FIG. 7 illustrates a flowchart corresponding to an example method for performing self-diagnostics in an illumination device. As shown in FIG. 7, a processor may receive 701 sensor data from one or more sensors in the sensor cavity. As discussed above, the sealed cavity may be maintained at the desired optimal conditions such as temperature, pressure, humidity, etc. In an embodiment, one or more sensors in the sensor cavity may monitor the conditions in the sealed cavity and may transmit the monitored data to the processor continuously, at fixed time intervals and/or occurrence of a triggering event. Examples of triggering events may include without limitation, user instructions, turning on and/or off of the illumination device, during manufacturing and quality testing, and occurrence of a fault or the like.

The processor may analyze 702 the received sensor data to detect 703 changes in one or more optimal conditions of a sealed path (i.e., the conduit). In an embodiment, the processor may analyze the received sensor data by comparing the received values for a condition with a threshold range and/or value and detect a change if the received value is above or below a threshold value and/or outside the threshold range. For example, the processor may detect a change if the received pressure value is outside a threshold range of about 0.9 atm to about 1.1 atm. Alternatively and/or additionally, the processor may also analyze the data to detect changes in the conditions of the sealed path by measuring a rate of change of a condition and comparing it to a threshold value. For example, the processor may compare a measured rate to change and determine whether the rate of change is more than a threshold value (i.e., rapid change). The processor may determine the rate of change by analyzing the sensed data over a period of time.

In an embodiment, if the processor detects a change, it may initiate corrective measures 704 to rectify currently existing faults in the illumination device (if the change is caused by a currently existing fault) and/or prevent malfunctioning of one or more components of the illumination device. Corrective measures are actions to change a setting, function, or other physical property of the illumination device in order to enable the illumination device to continue functioning after a fault, or to protect the illumination device and/or nearby devices from potential faults. Examples of corrective measures include, without limitation: (i) activating a switch or otherwise interrupting current to shut off power to the LED module in response to detection of high humidity levels (i.e., a humidity sensor detecting a humidity level above a threshold in the sealed cavity, or a rate of change of the humidity level in the cavity exceeding a threshold) in order to avoid short-circuiting of components while other modules such as communication modules may be kept active; (ii) causing a motor to adjust a position of the device in response to detecting that the device is not property oriented; (iii) opening a vent (which may include a valve) in the sealed cavity to release pressure in the cavity until a threshold pressure is achieved; (iv) activating a pump to increase pressure in the cavity until a threshold pressure is achieved; or other protective actions. In an embodiment, the processor may shut down all LED modules of the illumination device rather than just a single module. In an embodiment, the processor may shut down the illumination device completely until the corrective action is complete.

Alternatively and/or additionally, the processor may also generate alerts 706 upon detection of a change and/or determines that the rate of change is above a threshold value. In an embodiment, the alert may include information relating to a detected change and/or instructions for a user to perform corrective actions. In an embodiment, an alert may also convey information regarding the corrective measures initiated by the processor (if any). In an embodiment, an alert may be associated with a specific pattern that may be configured to provide information about the detected change. For example, rapidly blinking lights may indicate a failure of the heat sink causing a change in temperature of the illumination device, blinking lights at a different rate may be associated with a change in humidity, or the like. In an embodiment, the One possible corrective measure may include recalibration of air pressure inside the sealed cavity. In this embodiment, the system also may include a pump positioned to increase pressure in the sealed path when activated, and a vent positioned to relieve pressure in the sealed path when open. However, a pump may not be necessary in all embodiments. For example, pressure in the sealed path may be increased simply by heat generated by the LED modules and/or the power supply.

Embodiments that include a pump, the control card or other components may include a storage medium with programming (software and/or firmware) configured to cause a processor to activate the pump upon receipt of a signal from the pressure sensor indicating that the pressure in the sealed path has dropped below a lower threshold level, and to keep the pump running until pressure sensor data indicates that at least the lower threshold level has been restored. The software and/or firmware also may be configured to cause a processor to command the vent to open upon receipt of a signal from the pressure sensor indicating that pressure within the sealed path has risen below an upper threshold level, and to close the vent when the pressure has been relieved so that it has fallen below the upper threshold. The software and/or firmware also may be configured to cause a processor to command the LED modules to dim or turn off when the sensor(s) detect that pressure and/or humidity exceed an upper threshold value, or if at least a threshold amount of a chemical substance is present. The LED modules may remain dimmed or off for a set period of time, or until the sensor(s) detect that pressure and/or humidity and/or chemical substance concentration has dropped below a lower threshold value.

Optionally, the sensor cavity, control board, or other components of the system may be configured to transmit data from the sensor, an output of the self-diagnostic function, or both to a remote receiver. For example, in an embodiment, the illumination device may also include a wireless communication module configured to send and/or receive information to and/or from another device. In an embodiment, the communication module may be electrically connected (such as via an $I^2C$ communication protocol) to the sensors and may transmit detected data to a remote device. Examples communication methods may include, without limitation, a short-range communications such as near field communication (NFC), Bluetooth or Bluetooth low energy (BLE), ZigBee, radio frequency identification (RFID), LoRa or LoRaWAN, or long range communications such as Wi-Fi, over cellular networks, or the like.

Returning to FIG. 2, the power supply unit 30 may be detachable from the lighting device's housing 25 so that it can be replaced and/or removed for maintenance without the need to remove the entire device from an installed location, or so that it can be remotely mounted to reduce weight. The power supply unit 30, sensor cavity 32 and/or a portion of the lighting unit housing 25 may include one or more antennae, transceivers or other communication devices that can receive control signals from an external source. For example, the illumination device may include a wireless receiver and an antenna that is configured to receive control signals via a wireless communication protocol. Optionally, a portion of the lighting unit housing 25 or shroud 29 may be equipped with an attached laser pointer that can be used to identify a distal point in an environment to which the lighting device directs its light. The laser pointer can thus help with installation and alignment of the device to a desired focal point.

The fins 22*a* . . . 22*n* may be positioned substantially vertically (i.e., lengthwise from a top portion of the LED array structure and shroud 29 to a bottom portion of the same). Optionally, one or more lateral supports may be interconnected with the fins to provide support to the housing. The lateral supports may be positioned substantially parallel to the axis of the fins, or they may be curved to extend away from the LED structure, or they may be formed of any suitable shape and placed in any position. Each support may connect two or more of the fins. In this embodiment shown in FIG. 4, the fins and optional supports form the body portion 27 as a grate, and hot air may rise through the spaces that exist between the fins and supports of the grate. In addition, precipitation may freely fall through the openings of the grate. In addition, any small debris (such dust or bird droppings) that is caught in the grate may be washed away when precipitation next occurs.

It is intended that the portions of this disclosure describing LED modules and control systems and methods are not limited to the embodiment of the illumination devices disclosed in this document. The LED modules, control systems and control methods may be applied to other LED illumination structures, such as those disclosed in U.S. Patent Application Pub. No. 2014/0334149, titled "High intensity light-emitting diode luminaire assembly" (filed by Nolan et al. and published Nov. 13, 2014), and in U.S. Patent Application Pub. No., 2015/0167937, titled "High intensity LED illumination device" (filed by Casper et al. and published Jun. 18, 2015), the disclosures of which are fully incorporated herein by reference.

The features and functions described above, as well as alternatives, may be combined into many other systems or applications. Various presently unforeseen or unanticipated alternatives, modifications, variations or improvements may be made by those skilled in the art, each of which is also intended to be encompassed by the disclosed embodiments.

The invention claimed is:

1. A light fixture comprising:

a body portion comprising a housing, wherein the housing comprises an opening at a first end;

a plurality of light emitting diode (LED) modules, each of which is positioned in the opening, and each of which includes a circuit board and one or more LEDs;

a sensor cavity comprising one or more sensors; and a plurality of conduits that provide a sealed path between the LED modules and the sensor cavity so that the circuit boards and LEDs of the LED modules, the conduits and the sensor cavity exhibit a plurality of environmental conditions, wherein each of the plurality of environmental conditions are maintained at a corresponding constant level, and wherein the one or more sensors are configured to monitor the plurality of environmental conditions.

2. The light fixture of claim 1, further comprising:

a circuit board cavity that includes a circuit board with control electronics;

wherein the plurality of conduits also provide a sealed path between the LED modules, the sensor cavity, and the circuit board cavity.

3. The light fixture of claim 1:

further comprising a power supply cavity that contains a power supply; and wherein the plurality of conduits also provide a sealed path between the LED modules, the sensor cavity, and the power supply cavity.

4. The light fixture of claim 1, wherein each LED module comprises:

one or more lenses, each of which is positioned over a corresponding LED or group of LEDs;

a circuit board on which the one or more LEDs are mounted; and a frame that holds the one or more LEDs, lenses and circuit board.

5. The light fixture of claim 1, wherein the one or more sensors comprise one or more of the following: a pressure sensor, a temperature sensor, a humidity sensor, a chemical substance sensor, a fire sensor, a particulate sensor, a biological agent sensor, a moisture sensor, an air speed detector, or an orientation sensor.

6. The light fixture of claim 1, wherein the plurality of environmental conditions comprise one or more of the following: pressure, temperature, humidity, chemical substance presence, or particulate matter presence.

7. The light fixture of claim 1, further comprising:

a processor in communication with the one or more sensors; and a computer-readable medium containing programming instructions that are configured to, when executed by the processor, cause the processor to:

receive data corresponding to the plurality of environmental conditions from the one or more sensors, and analyze the data to determine if at least one of the plurality of environmental conditions has undergone one or more of the following:

a change so that a value of the at least one environmental condition exceeds a threshold level, a threshold change compared to corresponding constant level, or a rate of change that is greater than a threshold value.

8. The light fixture of claim 7, further comprising programming instructions that are configured to, when executed by the processor, cause the processor to, in response to detecting a change that exceed the threshold level, the threshold change or the rate of change that is greater than the threshold value, perform one or more of the following:

execute a corrective measure; or generate an alert.

9. The light fixture of claim 8, wherein the corrective measure comprises one or more the following:

shutting off power to one of the LED modules of the light fixture; or shutting off power to all of the LED modules of the light fixture.

10. The light fixture of claim 8, wherein the corrective measure comprises causing a motor to adjust an orientation of the light fixture.

11. The light fixture of claim 1, further comprising:

a processor in communication with the one or more sensors; and a computer-readable medium containing programming instructions that are configured to, when executed by the processor, cause the light fixture to turn off one or more of the LED modules upon receipt of data from the one or more sensors indicating that an air pressure level or humidity level within the sealed path has risen above an upper threshold level.

12. The light fixture of claim 1, further comprising:

a vent;

a processor in communication with the one or more sensors; and a computer-readable medium containing programming instructions that are configured to, when executed by the processor, cause the light fixture to open the vent upon receipt of data from the one or more sensors indicating that the air pressure level or humidity level within the sealed path has risen above an upper threshold level.

13. The light fixture of claim 1, further comprising:

a pump;

a processor in communication with the one or more sensors; and a computer-readable medium containing programming instructions that are configured to, when executed by the processor, cause the light fixture to initiate operation of the pump upon receipt of data from the one or more sensors indicating that the air pressure level or humidity level within the sealed path has fallen below a lower threshold level.

14. The light fixture of claim 1, further comprising:

a processor in communication with the one or more sensors;

a computer-readable medium containing programming instructions that are configured to, when executed by the processor, cause the processor to instruct the light fixture to receive data from the one or more sensors and perform a self-diagnostic function; and a transmitter configured to transmit the data from the one or more sensors, an output of the self-diagnostic function, or both to a remote receiver.

15. The light fixture of claim 1, wherein the sensor cavity is positioned proximate a rear end of the body portion that is opposite the opening, and the conduits pass from the opening to the sensor cavity through the body portion.

16. The light fixture of claim 15, wherein the body portion comprises a heat sink between the opening and the sensor cavity.

* * * * *